US005178097A

United States Patent [19]

Barr

[11] Patent Number: 5,178,097

[45] Date of Patent: Jan. 12, 1993

[54] HEAD GATE FOR CALF CHUTES

[76] Inventor: Carl E. Barr, Star Rte., Box 24, Hartville, Mo. 65667

[21] Appl. No.: 714,591

[22] Filed: Jun. 13, 1991

[51] Int. Cl.[5] ..... A61D 3/00

[52] U.S. Cl. ..... 119/99; 119/98

[58] Field of Search ..... 119/98, 99, 147.1

[56] References Cited

U.S. PATENT DOCUMENTS

| | | | |
|---|---|---|---|
| 1,799,073 | 3/1931 | Thompson | 119/99 |
| 2,113,741 | 4/1938 | Peterson | 119/99 |
| 2,308,213 | 1/1943 | Shearer | 119/99 |
| 2,633,248 | 5/1954 | Meyer et al. . | |
| 2,680,425 | 6/1954 | Hagel . | |
| 2,703,554 | 3/1955 | Haggard et al. . | |
| 2,842,098 | 7/1958 | Sudheimer . | |
| 2,847,974 | 8/1958 | Londgren . | |
| 2,935,966 | 5/1960 | Smith . | |
| 3,194,212 | 7/1965 | Sauer . | |
| 3,229,666 | 1/1966 | Sedevie . | |
| 3,371,653 | 3/1968 | Anderson . | |
| 3,808,729 | 5/1975 | Gilbaugh | 119/99 |
| 4,059,073 | 11/1977 | Roark . | |

FOREIGN PATENT DOCUMENTS

| | | | |
|---|---|---|---|
| 248834 | 1/1964 | Australia | 119/99 |
| 402108 | 1/1969 | Australia | 119/98 |
| 780015 | 7/1957 | United Kingdom | 119/98 |

*Primary Examiner*—Gene Mancene
*Assistant Examiner*—Todd E. Manahan
*Attorney, Agent, or Firm*—Kokjer, Kircher, Bowman & Johnson

[57] ABSTRACT

A head gate for immobilizing the head of a calf in a portable calf chute, includes one pivotal side bar and a second side bar mounted to pivot and slide axially. A top bar is rigidly carried on the second side bar. A linkage is operated by an overcenter handle to open and close the head gate. When closed, the side bars of the head gate trap the neck of the calf and the top bar pushes the head downwardly. A tension spring acts to hold the head gate open. A locking rod may be inserted in one of the side bars and hooked on a pin to secure the head gate in the open position when the calf chute is being moved between different locations.

17 Claims, 2 Drawing Sheets

HEAD GATE FOR CALF CHUTES

BACKGROUND AND SUMMARY OF THE INVENTION

This invention relates generally to the handling of calves and more particularly to an improved head gate for immobilizing the head of a calf in a calf chute.

Chutes that are equipped with head gates have long been used to immobilize the heads of animals during administration of shots and while the animal is being dehorned, castrated or otherwise treated. Typically, the head gate includes a pair of side bars which squeeze the neck of the animal on opposite sides when the head gate is closed. Examples are disclosed in U.S. Pat. Nos. 3,371,653 to Anderson; 2,935,966 to Smith; 2,680,425 to Hagel; 3,194,212 to Sauer; 3,229,666 to Sedevie; 2,842,098 to Sudheimer; 2,833,248 to Meyer et al.; 2,703,554 to Haggard et al.; 4,059,073 to Roark; and 2,847,974 to Londgren. Although this type of head gate is effective in preventing the animal from moving his head to either side, he can still move it up and down between the squeeze bars and can also shake his head up and down to possibly interfere with treatment.

The present invention is directed to an improved head gate which is specially constructed to force the head of the calf down as well as to prevent side to side movement. In accordance with the invention, a head gate includes two side bars which are uniquely arranged to squeeze the neck of the calf on opposite sides when the head gate is closed. Additionally, a top bar is carried rigidly on one of the side bars and forces the head of the calf downwardly to pin it between the top bar and the lower edge of the head opening. A unique linkage is provided to actuate all of the bars simultaneously to both trap the head of the calf and force it downwardly. The linkage includes an overcenter handle and an arrangement of the parts which locks the head gate securely closed when the handle is moved over center.

The invention is also characterized by a unique arrangement of the side bars. The side bar which carries the top bar is mounted for both pivotal and sliding movement between the opened and closed positions of the head gate, thus allowing the top bar to force the head of the animal downwardly. The other side bar is mounted for pivotal movement as the head gate is opened and closed.

The invention is further characterized by portability of the chute and by a locking rod which can be applied to lock the parts in place while the chute is being moved to a different location. Among the advantages of the invention are its effectiveness in holding the head of the calf against movement in any direction, its applicability to different types of chutes, its simplicity and reliability, and its operational safety.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
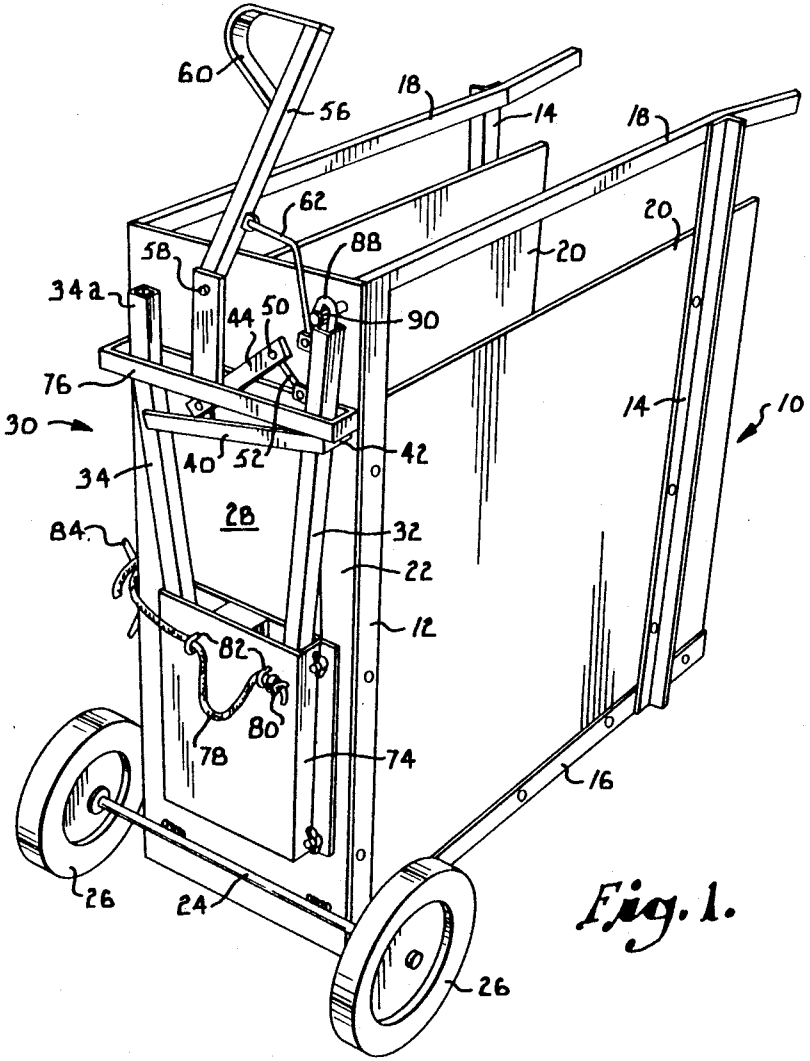
FIG. 1 is a perspective view of a calf chute equipped with a head gate constructed according to a preferred embodiment of the present invention, with the gate in the fully open position.

Referring now to the drawings in more detail and initially to FIG. 1, numeral 10 generally designates a calf chute of the type to which the present invention is applicable. The chute 10 includes a pair of vertical angle members 12 and 14 at the front and back ends of each of its opposite sides. The vertical angles 12 and 14 on each side are connected at the bottom by horizontal angles 16 and at the top by bars 18. Each side of the chute 10 is equipped with a flat side panel 20 which is suitably secured to the frame members of the chute. The side panels 20 are spaced apart on opposite sides of the chute so that a calf can stand in the chute between the side panels on a floor 21 (FIG. 2) supported on the lower angles 16. The back end of the chute is open so that calves can enter and depart from it.

Figure 2:
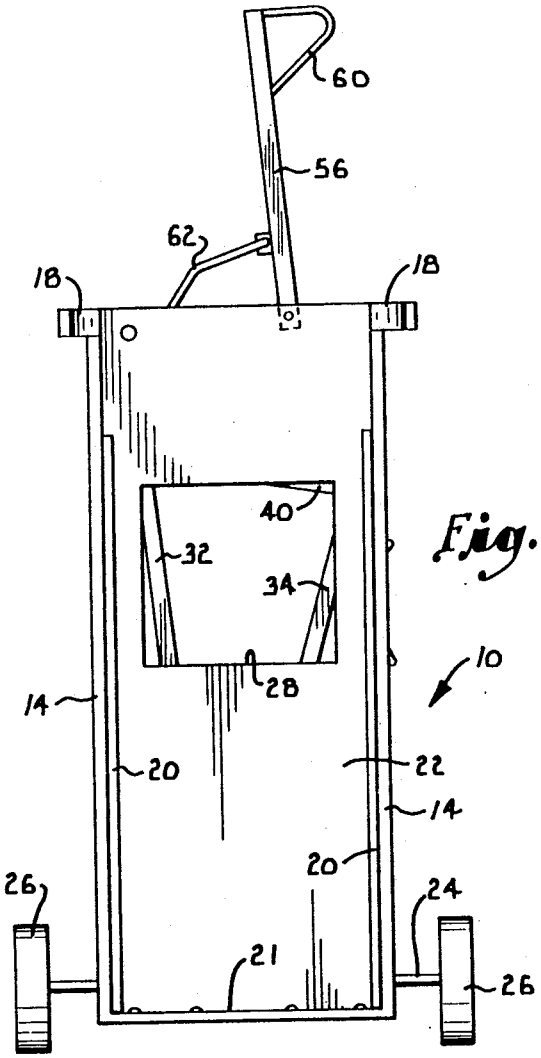
FIG. 2 is a rear elevational view of the calf chute shown in FIG. 1.
Figure 4:
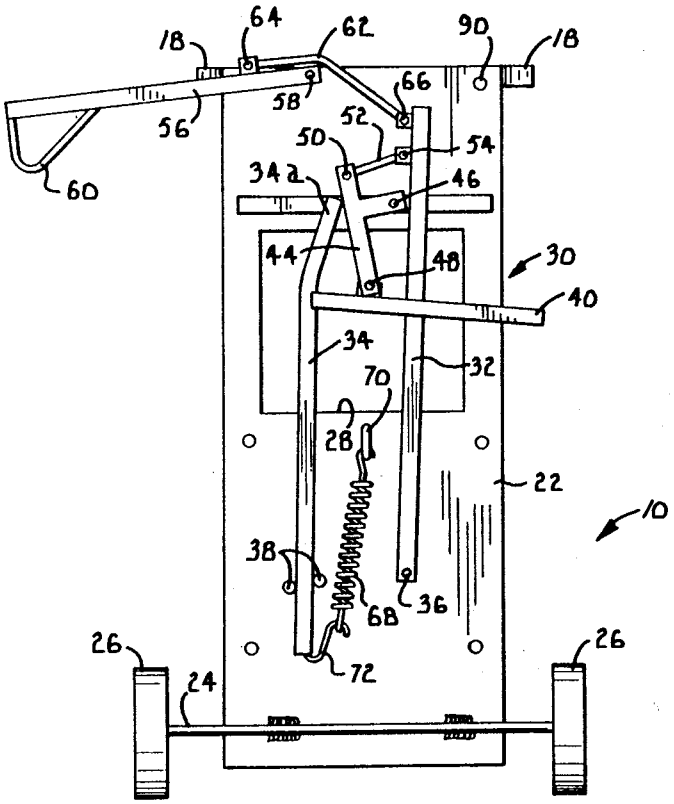
FIG. 4 is a front elevational view similar to FIG. 3, but showing the head gate in the fully closed position.
Figure 3:
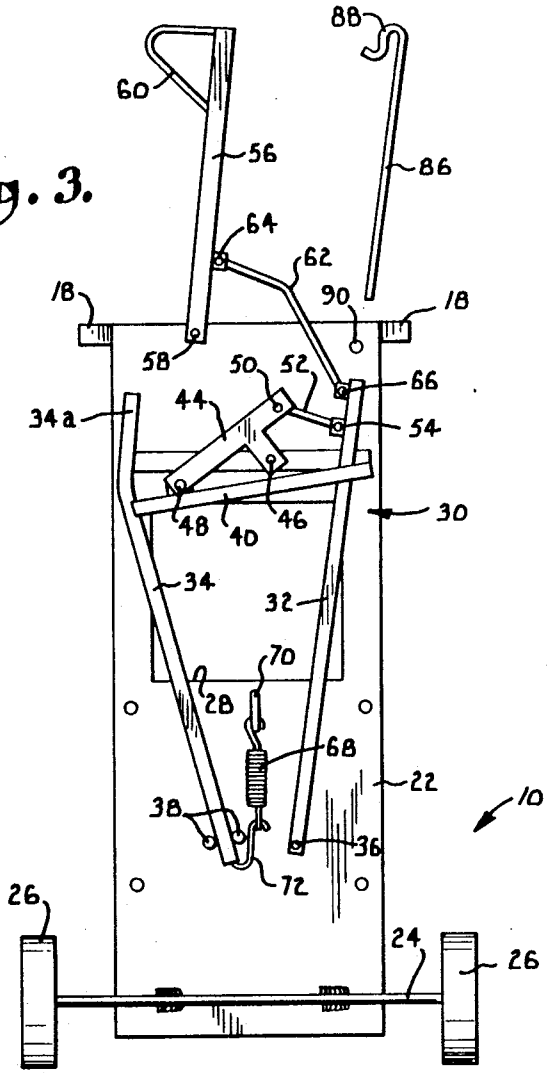
FIG. 3 is a front elevational view of the calf chute shown in FIG. 1, with the top and bottom covers removed for purposes of illustration and the head gate in the fully open position.

Referring now additional to FIGS. 2–4, the front end of the chute 110 is formed by a flat panel 22 which may be a metal panel secured to the front angles 12. A horizontal axle 24 equipped with wheels 26 on its opposite ends is secured to the lower part of the front panel 22. The chute 10 can be rolled between locations by raising its back end and rolling the chute to the desired location on the wheels 26.

The front panel 22 is provided with a square cut out which provides a head opening 28 for receiving the head of a calf standing in the chute 10. In accordance with the present invention, a head gate generally identified by numeral 30 can be moved manually between the fully open position shown in FIG. 3 and the fully closed position shown in FIG. 4. In the position of FIG. 3, the head gate provides enough room to allow the head of the calf to be extended through the head opening 28. In the closed position of FIG. 4, the head gate is closed on the neck of the animal in order to immobilize his head so that shots can be administered or other treatment to the animal can be carried out.

The head gate 30 includes a pair of opposing side bars 32 and 34 which are spaced apart near opposite sides of the head opening 28. Each of the side bars 32 and 34 is mounted on the front face of the end panel 22, and each side bar is a rigid member which may be formed from square tubing. The lower end of bar 32 is pivotally pinned at 36 to panel 22 at a location below the head opening 28. Bar 32 pivots about the pivot connection 36 between the open position of FIG. 3 and the closed position of FIG. 4.

The other side bar 34 is fitted near its lower end between a pair of spaced apart guides 38 which project from the front face of panel 22 at a location below the head opening 28. Bar 34 can slide longitudinally up and down between the two guides 38, and the bar 34 can also pivot to a limited extent between the two guides 38 as the head gate is moved between the open and closed positions. The upper end portion of bar 34 is bent inwardly, as indicated at 34*a*.

The head gate 30 further includes a generally horizontal top bar 40 which is rigidly secured at one end to the upper portion of the side bar 34. The top bar 40 extends from bar 34 toward bar 32 and may take the form of a pair of spaced apart, parallel bars which are welded at one end to the front and back faces of bar 34 and connected at the opposite end by an end bar 42 (see FIG. 1). The top bar 40 is located near the top end of the head opening 28 in the open position of the head gate.

A rigid link 44 has a horizontal arm which is pivotally pinned at 46 to the front face of end panel 22 of the calf chute at a location above the head opening 28. The lower end of link 44 is pivotally pinned at 48 to the top bar 40 at a location near its connection with the side bar 34. The top end of link 44 is pivotally pinned at 50 to one end of a linkage rod 52. The opposite end of rod 52 is pivotally pinned at 54 to bar 32 near its top end.

The head gate 30 is opened and closed by an operating handle 56 having its lower end pivoted at 58 to the end panel 22 near its top edge. The end of the handle 56 opposite the pivot connection 58 is equipped with a hand grip 60. A bent rod 62 is pivotally pinned at one end to the handle 56 by a pivot coupling 64. The coupling 64 is offset from the pivot connection 58 of the handle. The opposite end of the bent rod 62 is pivotally pinned at 66 to the top end of bar 32.

A tension spring 68 is hooked at its top end to an eye 70 projecting from the end panel 22 at a location centered below the head opening 28. The lower end of spring 68 is connected with a hook 72 secured to the lower end of bar 34.

Referring to FIG. 1 in particular, the spring 68 and the lower ends of the side bars 32 and 34 are enclosed within a cover 74 secured to the end panel 22. A top cover 76 is also applied to the end panel 22 in the area near the top ends of the side bars 32 and 34.

In operation of the calf chute 10, a calf enters the chute with the head gate in the fully open position shown in FIGS. 1 and 3. The head of the calf is received in extension through the head opening 28 between the side bars 32 and 34 and below the top bar 40. The head gate 30 can then be closed on the animal by pivoting the handle 56 from the position of FIG. 3 to the position of FIG. 4. As the handle is pivoted downwardly, the bent linkage rod 62 pulls the top end of bar 32 to the left, thus pivoting bar 32 in a counterclockwise direction about its pivot coupling 36. As the top end of bar 32 moves to the left, the short linkage rod 52 acts on link 44 and causes it to pivot in a clockwise direction about pivot coupling 46. Rotation of link 44 carries its lower pivot coupling 48 downwardly and to the right. Because of the rigid connection between the top bar 40 and the side bar 34, the side bar 34 is caused to slide downwardly between the guides 38 and also to pivot in a clockwise direction.

When the handle 56 has been moved to the position shown in FIG. 4, the head gate 30 is fully closed. The side bars 32 and 34 are both oriented vertically and confront opposite sides of the neck of the calf in order to prevent the head of the calf from moving side to side. The top bar 40 is moved downwardly against the top of the neck of the animal and forces its head downwardly, pinning the neck of the animal between the top bar 40 and the lower edge of the head opening 28. The head of the calf is thus immobilized and prevented from moving either from side to side or up and down so long as the head gate remains closed. Suitable treatment of the animal can be carried out with the head immobilized.

It is noted that with the head gate 30 in the fully open position, the tension spring 68 is essentially in an undeformed condition and acts to support the weight of the parts which load it. The spring holds the gate in the open condition. As the head gate is progressively closed, the side bar 34 is forced progressively downwardly, and this causes the tension spring 68 to stretch progressively. The spring 68 thus continuously urge bar 34 upwardly and opposes closing of the head gate.

During movement of handle 56 from the position of FIG. 3 to the position of FIG. 4, the handle is in a non-overcenter position until such time as the pivot coupling 64 is lowered far enough that a straight line between it and pivot coupling 66 is located below the pivot connection 58 for the handle 56. Once the handle 56 has reached this position, the handle is in an overcenter position and forces applied to bar 32 by the animal or the spring 68 are not effective to dislodge the handle from its overcenter position. At the same time as the handle breaks the overcenter position, the corner of the upper side bar 34*a* contacts the side of link 44. Further downward pivoting of the handle causes the bent rod 62 to spring slightly, allowing the handle to go overcenter. The spring force exerted by rod 62 thereafter helps to lock the handle in the overcenter position in conjunction with the force applied by spring 68. In this manner, the head gate 30 is automatically locked releasably in the closed position once the handle 56 has moved overcenter.

The head gate can be opened by pivoting the handle clockwise from the position of FIG. 4. Once the pivot coupling 64 has been raised far enough that a straight line between it and coupling 66 is located above pivot connection 58, the handle is in a nonovercenter position, and the deformed spring 68 then exerts a force that assists in moving the head gate to the fully open position of FIG. 3. It is also noted that the main body of the link 44 moves past a vertical position between the open and closed positions of the head gate. The end of the handle 56 is engaged against the bend in rod 62 to prevent handle 56 from being pivoted downwardly past the fully open position of the head gate shown in FIG. 4.

In this manner, the single operation of manually pivoting handle 56 results in trapping of the neck of the animal between the two side bars 32 and 34 and forcing the head downwardly due to the downward movement of the top bar 40 which accompanies closing of the head gate. A rope 78 (see FIG. 1) is knotted at one end at 80 and looped through two eyes 82 which project from the lower cover 74. The portion of the rope between the eyes 82 may be tightened on the snout of the calf, and the rope may be secured by tying it to a cleat 84 located on one side of the chute 10. The rope 78 thus holds the snout of the animal down so that access is provided to the upper portion of the head of the animal for dehorning or other treatment.

The head gate 30 may be locked in the open position during travel of the chute 10 from place to place on the wheels 26. A locking element takes the form of a rod 86 (see FIG. 3) having a hooked top end 88. The rod may be inserted downwardly into the tube which forms bar 32, and the hooked end 88 may be hooked onto a pin 90 projecting from the end panel 22. As best shown in FIG. 1, when the hook 88 is engaged on the pin 80, the side bar 32 is locked in place, and this in turn locks all of the other parts in place so that the head gate 30 is locked in the fully open position so long as the locking rod 86 is hooked on the pin 90. The locking rod 86 thus locks the handle 86 against movement while the chute 10 is being rolled from one location to another.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

I claim:

1. A head gate for holding the head of a calf, comprising:

a head opening for receiving the head of the calf, said head opening presenting a lower edge;

a pair of side bars mounted for movement between an open position wherein the head of the calf can be inserted between the side bars and a closed position wherein the side bars confront opposite sides of the neck of the calf to prevent removal of the head of the calf from the head opening, one of said side bars being mounted for pivotal movement and longitudinal sliding movement between the open and closed positions;

a top bar rigidly connected with said one side bar and movable downwardly against the top of the neck of the calf to force the neck downwardly against said lower edge of the head opening in response to movement of the side bars to the closed position;

manually opened means for effecting movement of said side bars to the closed position; and releasable means for locking the side bars in the closed position.

2. The head gate of claim 1, wherein said releasable means operates automatically to lock the side bars in the closed position upon movement of the side bars thereto.

3. The head gate of claim 1, wherein said manually operated means comprises:

a handle movable between an overcenter position and a nonovercenter position; and linkage means for moving the side bars to the closed position upon movement of said handle to the overcenter position.

4. The head gate of claim 3, wherein said linkage means includes a spring exerting a force urging said side bars toward the open position when the handle is in the non-overcenter position and toward the closed position when the handle is in the overcenter position, whereby said spring provides said releasable means.

5. The head gate of claim 1, wherein the other side bar is mounted for pivotal movement between the open and closed positions.

6. The head gate of claim 5, wherein said manually operated means comprises:

a pivotal handle; and a linkage connecting said handle and said side bars in a manner to move the side bars toward one another to the closed position and to simultaneously lower said top bar when the handle is pivoted in one direction.

7. The head gate of claim 6, wherein:

said handle is pivotal in said one direction to an overcenter position and in an opposite direction to a non-overcenter position; and said releasable means includes a spring acting to retain said handle in the overcenter position upon movement thereto and acting to urge said side bars toward the open position upon movement of the handle to the non-overcenter position.

8. The head gate of claim 1, including a releasable locking element for locking said side bars in the open position.

9. In a chute for calves, the improvement comprising:

a head opening in one end of the chute for receiving the head of a calf standing in the chute, said head opening having a fixed bottom edge;

first and second side bars mounted adjacent said head opening for movement between an open position for receiving the head of a calf and a closed position for holding the neck of the calf, said first side bar being pivotally movable between the open and closed positions and said second side bar being pivotally and slidably movable between the open and closed positions;

a top bar rigidly connected with said second side bar and movable therewith downwardly to pin the neck of the calf between the top bar and said bottom edge of the head opening when the side bars are moved to the closed positions;

a manually operated handle movable between an overcenter position and a non-overcenter position;

linkage means for effecting the open position of said side bars in the non-overcenter position of the handle and the closed position of said side bars in the overcenter position of said handle; and spring means acting to releasably retain said side bars in the closed position when the handle is moved to the overcenter position.

10. The improvement of claim 9, wherein said linkage means comprises:

a link pivotally connected to the chute and to said top bar; and a linkage rod pivotally connected to said link and to said first side bar.

11. The improvement of claim 10, wherein said linkage means comprises a bent linkage rod pivotally connected to said handle and to said first side bar.

12. The improvement of claim 9, including a releasable locking element for locking said handle in the non-overcenter position.

13. A chute structure for calves, comprising:

a calf chute having a pair of opposite sides spaced apart to receive a calf therebetween, said chute having one end presenting a head opening bounded by a lower edge;

first and second side bars mounted on said one end of the chute for movement toward and away from one another between a closed position wherein the neck of the calf is squeezed between the side bars and an open position wherein the neck of the calf is free of the side bars;

a top bar rigidly connected with said first side bar and movable downwardly therewith when the side bars are moved toward one another to pin the neck of the calf between the top bar and said bottom edge of the head opening in the closed position of the side bar;

a manually operated handle mounted pivotally on said one end of the chute for movement between overcenter and non-overcenter positions;

a rigid link having opposite first and second ends, said link being pivotally connected to said top bar at said first end and to said one end of the chute at a location between said first and second ends;

a first linkage rod connected pivotally to said second side bar and to said second end of the link; and a second linkage rod connected pivotally to said handle and to said second side bar, said link and said first and second linkage rods being arranged to effect movement of said side bars to the closed position upon movement of said handle to the overcenter position and to the open position upon movement of said handle to the non-overcenter position.

14. The chute structure of claim 13, including:

wheels on said chute for rolling of the chute from place to place; and a releasable locking element for locking said side bars in the open position while the chute is being rolled.

15. The chute structure of claim 13, including spring means for releasably locking said side bars in the closed position in the overcenter position of the handle and in the open position in the non-overcenter position of the handle.

16. The chute structure of claim 13, wherein:

said first side bar is mounted to slide and pivot on said one end of the chute when the side bars move between the open and closed positions; and said second side bar is mounted to pivot on said one end of the chute when the side bars move between the open and closed positions.

17. The chute structure of claim 13, wherein:

said first side bar is mounted to slide and pivot on said one end of the chute when the side bars move between the open and closed positions; and said second side bar is mounted to pivot on said one end of the chute when the side bars move between the open and closed positions.

* * * * *